US006438442B1

(12) United States Patent
Guericke et al.

(10) Patent No.: US 6,438,442 B1
(45) Date of Patent: Aug. 20, 2002

(54) METHOD FOR AUTOMATIC CONDUCTING OF A STRAIGHTENING PROCESS

(75) Inventors: Wilhelm Guericke, Magdeburg; Marcus Paech, Wittenberge; Eckehard Albert, Berlin, all of (DE)

(73) Assignee: Witels Apparate-Maschinen Albert GmbH & Co. KG, Berlin (DE)

( * ) Notice: Subject to any disclaimer, the term of this patent is extended or adjusted under 35 U.S.C. 154(b) by 0 days.

(21) Appl. No.: 09/331,479

(22) PCT Filed: Dec. 17, 1997

(86) PCT No.: PCT/EP97/07092

§ 371 (c)(1),
(2), (4) Date: Jun. 21, 1999

(87) PCT Pub. No.: WO98/28098

PCT Pub. Date: Jul. 2, 1998

(30) Foreign Application Priority Data

Dec. 20, 1996 (DE) ..... 196 53 569

(51) Int. Cl.[7] ..... G06F 19/00

(52) U.S. Cl. ..... 700/145; 72/6.2; 72/7.6; 72/369

(58) Field of Search ..... 700/145, 148, 700/146, 117, 28; 72/6.2, 7.1, 7.2, 7.6, 8.9, 219, 369

(56) References Cited

U.S. PATENT DOCUMENTS

| | | | | | |
|---|---|---|---|---|---|
| 3,650,137 | A | * | 3/1972 | Benz | 72/165 |
| 3,685,271 | A | * | 8/1972 | Wall et al. | 57/68 |
| 4,425,776 | A | * | 1/1984 | Judge, Jr. | 72/306 |
| 4,825,674 | A | * | 5/1989 | Tanaka et al. | 72/98 |
| 4,939,042 | A | * | 7/1990 | Thuse | 428/610 |
| 5,341,303 | A | * | 8/1994 | Foroudastan et al. | 700/145 |
| 5,467,629 | A | * | 11/1995 | Albert | 72/164 |
| 5,520,039 | A | * | 5/1996 | Albert | 72/164 |
| 5,642,291 | A | * | 6/1997 | Prunotto et al. | 700/145 |
| 5,692,405 | A | * | 12/1997 | Kirii | 72/16.1 |
| 5,797,288 | A | * | 8/1998 | Mas | 72/7.1 |
| 5,802,901 | A | * | 9/1998 | Oda et al. | 72/161 |
| 5,917,726 | A | * | 6/1999 | Pryor | 700/95 |

FOREIGN PATENT DOCUMENTS

| | | |
|---|---|---|
| DE | 1 752 406 | 9/1971 |
| DE | 38 40 016 A1 | 5/1990 |
| DE | 195 03 850 C1 | 6/1996 |
| GB | 2188450 | 9/1987 |
| JP | 58 116931 | 7/1983 |
| JP | 63 026219 | 2/1988 |

OTHER PUBLICATIONS

Wilhelm Guericke & Marcus Paech, "Simulation of the wire straightening process" *Wire Industry*, Aug. 1996, pp. 613–620.

"Justierung Von Drahtrichtapparaten Draht", vol. 47, No. 6, Jun. 1, 1996, p. 365.

Martin Hoffmann & Albert Sedlmaier, "Durchgängige CAD/CAM–Lösungen für Blechbiegeteile", *Blech Rohre Profile*, 1992. No. 10, pp. 776–780.

* cited by examiner

*Primary Examiner*—Leo Picard
*Assistant Examiner*—Chad Rapp
(74) *Attorney, Agent, or Firm*—Pauley Petersen Kinne & Erickson

(57) ABSTRACT

A method for automatic conducting of a straightening process for an object to be straightened, such as sheet metal, strips, sections, pipes, and in particular for wire-like or multiwire-like objects that are to be straightened, in a straightening device or a levelling machine with at least one mangle roll which can be adjusted by an actuator. In accordance with this invention, a process simulation model of a straightening process that is to be conducted, and a process simulation program are set up, and the latter gives directly "online" the settings of the adjustable mangle rolls. During the straightening process, changes in the product data, in particular the material characteristics and/or dimensions of the objects to be straightened which influence the realization of the straightening process, are recorded, and from these, data for setting the adjustable mangle rolls are also calculated, and signals are emitted for the automatic setting of the adjustable mangle rolls using at least one actuator.

17 Claims, 2 Drawing Sheets

METHOD FOR AUTOMATIC CONDUCTING OF A STRAIGHTENING PROCESS

BACKGROUND OF THE INVENTION

1. Field of the Invention

This invention relates to a process for automatic control of a straightening process for a material to be straightened, such as sheet metal, strips, sections, pipes and, in particular, for wire-like or multiwire-like objects to be straightened, in a straightening apparatus or a levelling machine having at least one straightening roller, adjustable with an actuator.

2. Description of Prior Art

In order to eliminate buckling of objects to be straightened, non-rotary roller straightening apparatus or levelling machines are employed. Due to the level-sefting of the straightening rollers in relation to one another, disposed in two rows in a mutually offset manner in at least one straightening plane, the objects to be straightened are subjected to alternating bends during their passage. The quantity and magnitude of the alternating bends should be selected so that entry curvatures of objects to be straightened are eliminated over an entire length of the objects to be straightened.

Predetermining a number of alternating bends, and a magnitude of the alternating bends, is set in practice more or less intuitively according to the experience of the person operating the straightening apparatus using level-seftings of the straightening rollers. Changing the set parameters of the individual straightening rollers is thus performed by visual contact with the exiting material to be straightened until satisfactory straightness is attained.

From Guedcke W., "Simulation of the Wire Straightening Process" Wire Industry, Volume 63, No. 752, Aug. 1, 1996, modelling and simulation of wire straightening processes is known. Such modelling aims to discover the most ideal conditions for a straightening process and discloses specifications for conducting a straightening process. However, a specialist is required for adapting the pre-set process cycle to the actual conditions with regard to the tolerances of the respective objects to be straightened, which is attempted by adjusting the straightening rollers and by taking measurements after interrupting the straightening process.

From German Patent Reference DE 195 03 850 C1 a non-rotary straightening apparatus for bending machines with an integrated measuring device is known. In the straightening apparatus, in a direction in which material is passing through, at least one material bending measuring device, in which there is at least one measuring path for a lengthwise predetermined material section, is disposed behind at least one straightening mechanism. Thus, along the measuring path, there is at least one mechanical and/or electronic and/or optical sensor, determining the extent of the bend and its orientation, in which context signals are generated by the sensor device, representing the measured bend of the material section, and the signals are used to adjust an adjusting gear accordingly.

The measuring device of the known straightening apparatus operates according to a principle of curvature detection in terms of a Three-Point-Method, supplying correct results only for objects to be straightened, which are cut into sections, or for immobile objects to be straightened, for example if the objects to be straightened are free from exterior forces and moments, neglecting gravity. If the curvature of the discharged objects to be straightened is not constant over a length of the measuring path, the measuring result is further influenced by the length of the measuring path.

The straightening process is interrupted due to the required immobilization of the objects to be straightened. The immobilization and renewed setting into motion affects the result of the curvature measurements and necessitates changes which have an effect on a quality of the straightening process. Checking the setting is thus only possible by renewed immobilization of the straightening apparatus, i.e. continuous monitoring and adjusting while the objects to be straightened are moving or during straightening, is not possible.

SUMMARY OF THE INVENTION

It is one object of this invention to provide a process which virtually permits an immediate, automatic adaptation of the setting to continuously measured data of respective objects to be straightened of at least one straightening roller of a straightening apparatus or a levelling machine, without interrupting the straightening process.

This object is attained by a process having the characteristics described in this specification and in the claims.

Preferred embodiments of this invention are based on the principle of modelling a straightening process, which is to be automated, in a preparatory phase, using mathematical-physical laws, setting up a simulation program and performing a calculus of parameters with the simulation program with varying product data, in particular the material characteristics and/or the dimensions of the objects to be straightened. This phase may be considered as "offline". Due to product and/or process data measured continuously during the straightening process, i.e. without immobilizing the objects to be straightened, the adjustment of the straightening apparatus or the levelling machine, required in order to attain the desired product quality, is performed very quickly "online", integrating the results of the calculus of parameters. The change of the setting is performed objectively and in a determined manner. The measured product and/or process data are also used in order to check the set up model as well as the simulation program and to change them, if necessary. Objectivity replaces subjective experience judgement by the eye of the person operating the straightening apparatus or levelling machine. This not only simplifies the process, performing it automatically, but it also enhances the quality.

BRIEF DESCRIPTION OF THE DRAWINGS

This invention is described in more detail with reference to two figures, wherein.

DESCRIPTION OF PREFERRED EMBODIMENTS

Figure 1:
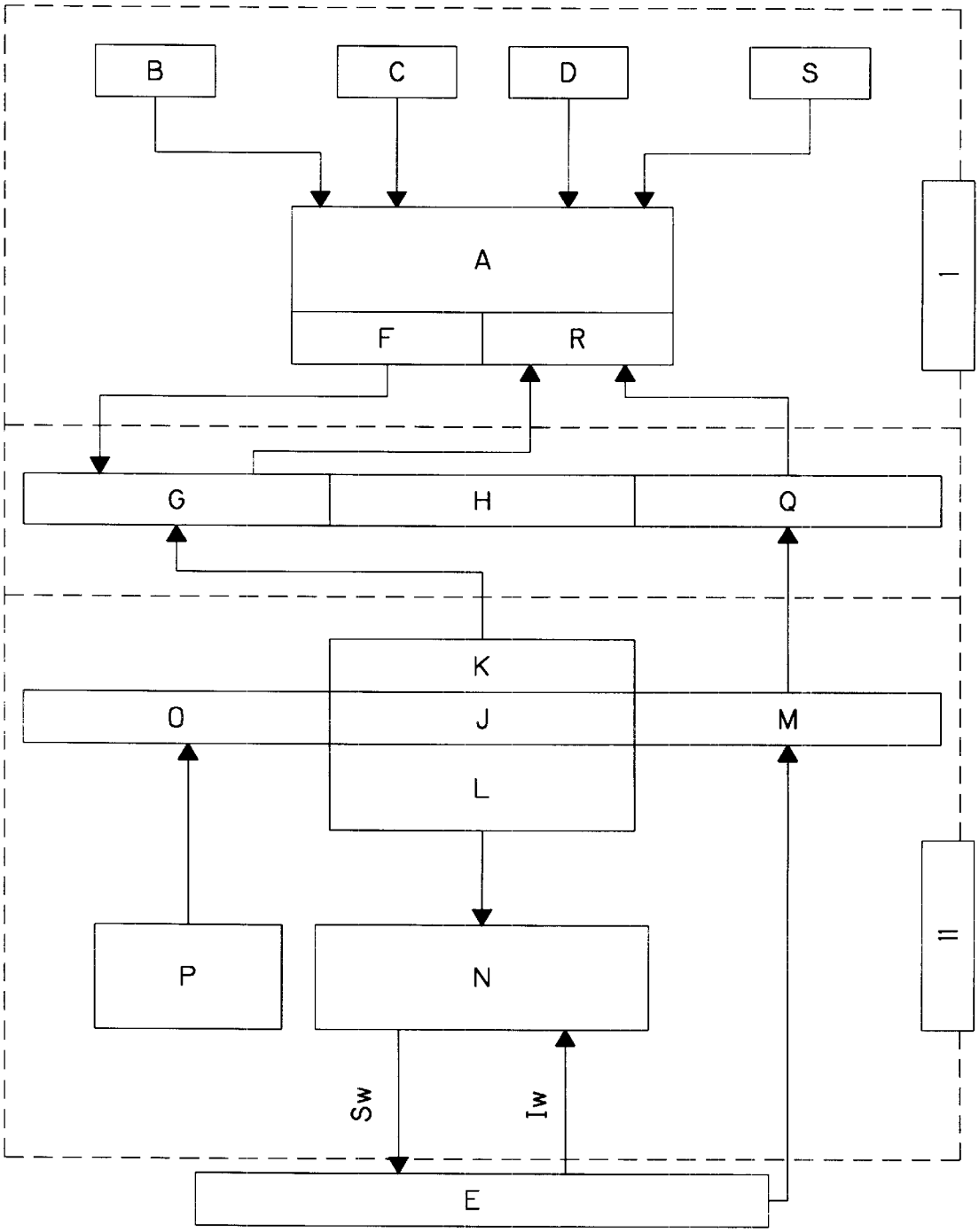
FIG. 1 illustrates one embodiment of an automatic process control according to this invention.

During the preparatory phase I a process simulation program A, by way of which the straightening process to be automated can be imitated in a virtual manner, is set up and used. In the process simulation, program A, machine data B, technological sequence data C of the intended straightening process, material data D of objects to be straightened, and a desired quality S for straightness or evenness, residual stress state via the cross-section of the objects to be straightened, material characteristics, such as a desired apparent yield point and/or influence on the distinct yield point of the straightened objects are entered.

The process simulation program A is subject to a calculus of parameters F, in which parameters, for example the geometrical dimensions and/or the yield point of the objects to be straightened vary. Preferably, those parameters, to the change of which the straightening apparatus or the levelling machine E is supposed to react automatically, are varied. Parameters are adjusted to the specificity of the respective straightening process and/or of the straightening apparatus or the levelling machine E. The results of the calculus of parameters F are product and/or process data and the target parameters required for automation, i.e. the required level-sefting(s) of straightening roller(s) in order to attain the desired quality. All calculation results of the calculus of parameters F are stored in a database in the form of reference matrices G.

In a realization phase II a process calculation model J is provided, referring back to the reference matrices G and therefore to the correlations between the influencing variables and the target variables of the straightening process, set up in the preparatory phase I and performing, as a function of the recorded production data O, the reference matrices selection K and the appropriate recall from the overriding material flow or the material tracking system (MTS) P. The process calculation model J realizes on this basis and in consideration of product and/or process data M, determined in a measuring technical manner, the calculation and emission of the target parameters, i.e. the desired level-sefting values L by means of assessment statistics methods. For the basic automation N these target parameters correspond to the desired values Sw. The momentary set values Iw are compared to the desired values Sw, in which case the deviations are used to adjust both values. The product and/or process data M, determined in a measurement-technical manner, are filed in the database H in processed form Q. They may contribute to an optimization R of the process simulation model and of the process simulation program A in a subsequent preparatory phase.

An appropriately modified realization phase II comprises a plurality of operators. Apart from an operator for adjusting or automatically correcting the adjusting values, an operator for the basic adjustment of the straightening apparatus or of the levelling machine immediately prior to the commencement of production as well as an operator for the recordal of the measured values are implemented. Prior to the admission of the objects to be straightened a measurement of thickness is performed, e.g. by means of laser distance sensors. The thickness value is passed on to the level-sefting operator. At the same time, a value for the yield point of the object to be straightened is received, which comes either from the overriding material flow or the material tracking system P or is established by means of the yield point operator. For this purpose the yield point operator uses the information content from a reference matrix G, selected and called up from the database H, as well as measuring results of the process magnitude, the straightening force. The yield point determined by the yield point operator is checked for plausibility. The adjustment operator can pass the desired adjustment values to the basic automation N by way of the information on thickness and yield point of the objects to be straightened, using selected and called-up reference matrices G. This means that the adjustments of the straightening roller(s), derived in this manner, take into account the respective thickness and yield point of the objects to be straightened. This ensures a constant quality of the objects to be straightened, regardless of fluctuations between these two parameters.

Apart from the straightening force, this invention also permits the use of other process parameters for automation and/or the reaction to fluctuations between other parameters of the objects to be straightened. For example, the curvature paftem of the objects to be straightened in a straightening apparatus or in a levelling machine can be measured and compared to a simulated curvature pattern. The comparison results allow to make detailed statements on the objects to be straightened or on the state of the straightening process. There also exists a plurality of possibilities to organize the process control, depending on the frequency of the change of the properties of the objects to be straightened, which may change, for example, from batch to batch, from one material to be straightened to the other and/or over the length of the material to be straightened.

By separating the preparatory phase I from the realization phase II even very rapidly performed straightening processes may be automated. The automatic conducting of a straightening process as set out, is universally applicable and not time-dependant.

Figure 2:
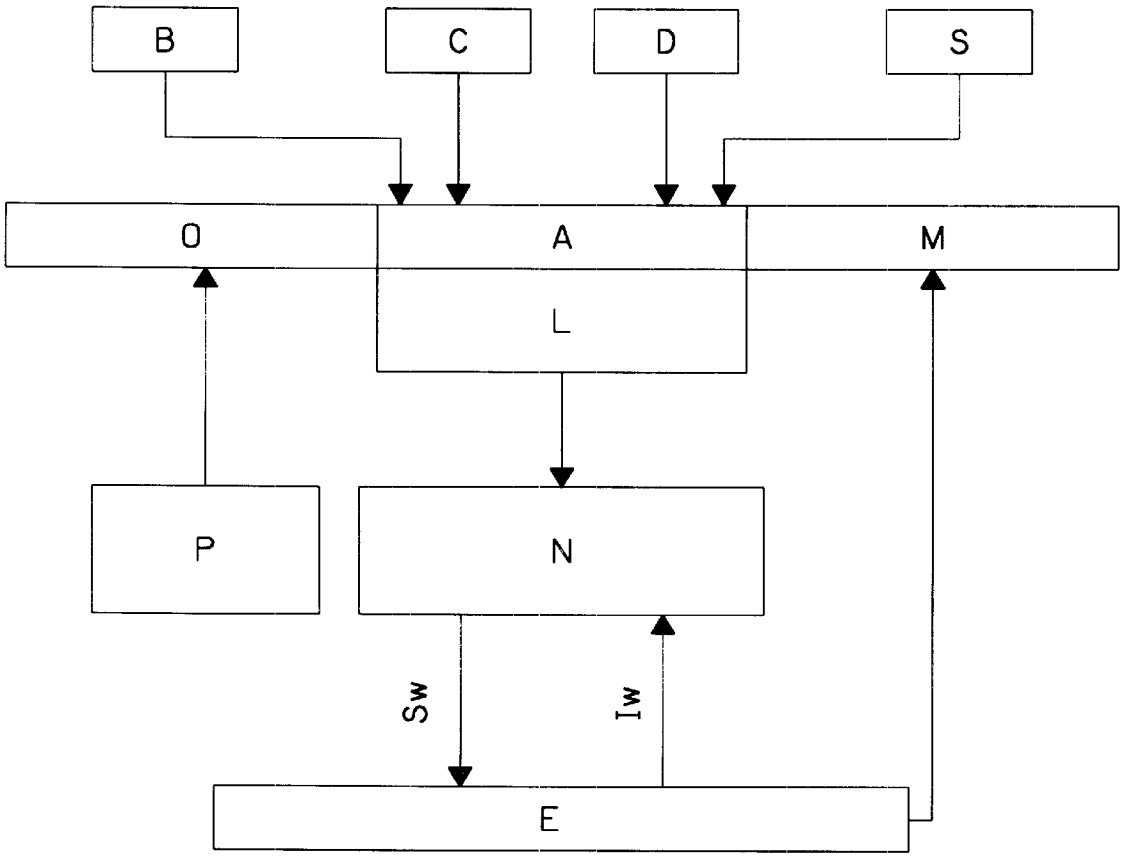
FIG. 2 illustrates another embodiment of an automatic process control according to this invention.

The embodiment illustrated in FIG. 2 is denoted by units or values matching the letters according to FIG. 1 and which are, therefore, not further elucidated. In this example the process simulation program A, taking into account the product and/or process data M, determined in a measurement technical manner, and the recorded production data O, passes on the desired values L directly to the basic automation N.

What is claimed is:

1. A process for automatic control of a straightening process for a material to be straightened, including sheet metal, strips, sections, pipes and wire objects, in one of a straightening apparatus and a levelling machine having at least one straightening roller, adjustable with an actuator, the process comprising: predetermining, on a basis of which a process simulation model of a straightening process is to be performed and a process simulation program directly online settings of the at least one straightening roller, wherein during the actual performance of the straightening process recording changes of product data, including material properties, having an effect on at least one of an operation of the straightening process and dimensions of respective ones of the objects to be straightened, at least one actuator emitting a signal corresponding to resultant data and using the resultant data to calculate a setting of the at least one adjustable straightening roller, and a yield point of the material to be straightened being continuously determined as a function of a respective product the process data.

2. A process according to claim 1, wherein a distinct yield point is one of calculated, reduced and eliminated for ferrous metals.

3. A process according to claim wherein a residual stress state is calculated using a cross-section of the material to be straightened.

4. A process according to claim 1, wherein virtual presentations of the straightening process are set up via the process simulation model and the process simulation program, using data regarding one of the straightening apparatus and the levelling machine desired technological steps, geometrical dimensions and material properties and regarding a desired quality of the respective material to be straightened.

5. A process according to claim 1, wherein simulation calculations are carried out with the process simulation program according to the process simulation model and results are at least one of stored and entered into a process calculation model.

6. A process according to claim 1, wherein the process simulation model and the process simulation program are optimized using measured data recorded during the straightening process.

7. A process according to claim 1, wherein a process simulation model and a process simulation program are set up in a preparatory step.

8. A process according to claim 7, wherein simulation calculations are performed and results are entered into a process calculation model to predetermine the settings of the at least one adjustable straightening roller.

9. A process according to claim 8, wherein the simulation calculations are carried out with the process simulation program according to the process simulation model and results are at least one of stored and entered into the process calculation model.

10. A process according to claim 9, wherein the process simulation model and the process simulation program are optimized using measured data recorded during the straightening process.

11. A process according to claim 10, wherein a residual stress state is calculated using a cross-section of the material to be straightened.

12. A process according to claim 11, wherein a distinct yield point is one of calculated, reduced and eliminated for ferrous metals.

13. A process according to claim 12, wherein virtual presentations of the straightening process are set up via the process simulation model and the process simulation program, using data regarding one of the straightening apparatus and the levelling machine desired technological steps, geometrical dimensions and material properties and regarding a desired quality of the respective material to be straightened.

14. A process according to claim 13, wherein a respective state of a shape of the material to be straightened when entering the one of the straightening apparatus and the levelling machine are recorded as geometrical magnitudes.

15. A process according to claim 14, wherein the process simulation program is subjected to a calculus of parameters.

16. A process according to claim 14, wherein the process simulation program is subjected to a calculus of parameters.

17. A process according to claim 5, wherein at least one reference matrix is created from the process simulation program subjected to the calculus of parameters.

* * * * *